US008191191B2

(12) United States Patent
Montross

(10) Patent No.: US 8,191,191 B2
(45) Date of Patent: Jun. 5, 2012

(54) APPARATUS AND METHOD FOR LIFTING A MATTRESS

(75) Inventor: Sam Montross, Ft Lauderdale, FL (US)

(73) Assignee: Cadence Keen Innovations, Inc., Ft. Lauderdale, FL (US)

( * ) Notice: Subject to any disclaimer, the term of this patent is extended or adjusted under 35 U.S.C. 154(b) by 0 days.

(21) Appl. No.: 13/121,651

(22) PCT Filed: Oct. 14, 2009

(86) PCT No.: PCT/US2009/060669

§ 371 (c)(1),
(2), (4) Date: Mar. 29, 2011

(87) PCT Pub. No.: WO2010/045351

PCT Pub. Date: Apr. 22, 2010

(65) Prior Publication Data

US 2011/0179578 A1 Jul. 28, 2011

Related U.S. Application Data

(60) Provisional application No. 61/136,902, filed on Oct. 14, 2008.

(51) Int. Cl.
*A47C 21/02* (2006.01)
*A47C 31/02* (2006.01)

(52) U.S. Cl. ..... 5/660; 5/488; 254/104

(58) Field of Classification Search ..... 5/488, 660, 5/658, 503.1; 7/166, 169; 254/88, 104; 292/343
See application file for complete search history.

(56) References Cited

U.S. PATENT DOCUMENTS

| | | | | |
|---|---|---|---|---|
| 159,949 | A | | 2/1875 | McDermott |
| 165,984 | A | | 6/1875 | Cosbey |
| 188,376 | A | | 3/1877 | Kelly |
| 466,104 | A | | 12/1891 | Neagele |
| 542,559 | A | | 7/1895 | Harmon |
| D31,941 | S | | 12/1899 | Root |
| 759,868 | A | | 5/1904 | Eioh |
| 1,192,719 | A | | 7/1911 | Wells |
| 1,195,423 | A | | 8/1916 | Waters |
| 1,356,431 | A | * | 10/1920 | Eddy ..... 7/164 |
| D107,109 | S | | 11/1937 | Carter |
| 2,733,894 | A | | 2/1956 | Overman |
| 2,774,178 | A | * | 12/1956 | Nelson ..... 81/488 |
| 3,185,442 | A | | 5/1965 | Hempill |
| 3,377,052 | A | | 4/1968 | Hagen |
| 3,381,937 | A | | 5/1968 | Zillman |
| 3,551,016 | A | * | 12/1970 | Hooper ..... 294/25 |
| D238,745 | S | | 2/1976 | Bedard et al. |
| 4,433,463 | A | | 2/1984 | DuVal |

(Continued)

*Primary Examiner* — Michael Trettel
(74) *Attorney, Agent, or Firm* — Christopher & Weisberg, P.A.

(57) ABSTRACT

A mattress lift apparatus is provided for insertion between a mattress and an underlying support structure, such as a box spring. The mattress lift apparatus elevates a portion of the mattress so that bed linens may be tucked between the mattress and the underlying support structure. A continuous loop is formed by a base member, an incline member, a transition member and a handle member, wherein the continuous loop provides structural integrity to the mattress lift apparatus. An aperture is formed within the continuous loop, including along an inside portion of the handle member to enable the handle member to be gripped. In one embodiment, the handle member includes a substantially semi-circular shape. In another embodiment, at least one support rib is positioned in the aperture to mechanically couple the base member and at least one of the inclined member and the transition member.

20 Claims, 4 Drawing Sheets

U.S. PATENT DOCUMENTS

| | | | | | |
|---|---|---|---|---|---|
| 4,451,024 | A | | 5/1984 | Shepherd | |
| D286,008 | S | | 10/1986 | Hillinger | |
| 4,688,761 | A | * | 8/1987 | Wilcox | 254/104 |
| 5,011,203 | A | * | 4/1991 | Tackett | 292/343 |
| D317,482 | S | | 6/1991 | Michaelsen et al. | |
| 5,290,012 | A | | 3/1994 | Cottriel et al. | |
| 5,374,033 | A | | 12/1994 | Tilman | |
| RE34,889 | E | | 4/1995 | Fogarty et al. | |
| 5,690,316 | A | | 11/1997 | Madjarac | |
| D410,380 | S | | 6/1999 | Towns | |
| 7,398,569 | B2 | * | 7/2008 | Sakaldasis et al. | 5/488 |
| D590,676 | S | | 4/2009 | Pickard | |
| 7,581,270 | B1 | | 9/2009 | Levensque | |
| D602,324 | S | | 10/2009 | Hancock et al. | |
| 7,644,964 | B2 | | 1/2010 | Bushey et al. | |
| 7,707,669 | B1 | * | 5/2010 | Richardson | 5/660 |
| D622,569 | S | * | 8/2010 | Montross | D8/47 |
| 7,818,837 | B2 | * | 10/2010 | Gonser, Jr. | 5/488 |

* cited by examiner

APPARATUS AND METHOD FOR LIFTING A MATTRESS

CROSS REFERENCE TO RELATED APPLICATIONS

This application is a §371 national phase entry of International Application No. PCT/US2009/060669, filed Oct. 14, 2009, which claims priority to U.S. Provisional Patent Application No. 61/136,902, filed Oct. 14, 2008, the entire contents of which are incorporated herein by reference.

FIELD OF THE INVENTION

The invention relates to an apparatus and method for lifting a mattress. More particularly, the invention relates to an apparatus and method for elevating a portion of a mattress from an underlying support structure, so that bed linens may be tucked between the mattress and underlying support structure.

BACKGROUND OF THE INVENTION

Beds are important furniture items used for sleeping. Beds include a mattress and an underlying support structure, such as a box spring or other support structure. Unlike other furniture items, beds require daily maintenance that includes dressing the mattress with bed linens, blankets, bedspreads and/or comforters.

Mattresses are bulky and heavy to lift. Handling these mattresses may strain a bed maker's body, resulting in back and neck fatigue, pain, injury, lost productivity and medical claims. This is especially true in the hospitality industry, hospitals or other industries where housekeepers routinely make or change tens or hundreds of beds in a single day.

When changing a bed, consumers typically lift and hold the mattress to apply a fitted linen over the four corners of the bed. When making or continuing to change the bed, a flat linen may be draped over the mattress and the flat linen is tucked in between the mattress and the underlying support structure. In order to tuck in the flat linen, a bed maker typically lifts the mattress away from the underlying support structure, holds the mattress in the elevated position, twists their body linen and tucks the linen between the mattress and the underlying support structure. This process requires strength. Repeating this process multiple mattresses in a single day requires strength and endurance. Without warning, lifting and/or holding mattresses in an elevated position may physically injure even the most careful bed makers.

The bed making process may be further complicated by physical limitations in the areas that are available for making the beds. For example, some mattresses may be located in restricted areas that limit physical access to the mattresses and prevent the use of safe lifting techniques. Other barriers to bed making may exist, such as the existence of structural impediments, including night stands, other furniture, foot boards, head boards, bed rails, slats, bed skirts or other structural impediments. While devices are available to assist bed makers in raising the mattresses while making beds, some of these devices are difficult to use, others are complex or still others are costly. The invention overcomes these and other drawbacks.

SUMMARY OF THE INVENTION

Various aspects of the invention overcome at least some of these and other drawbacks of existing devices. The invention provides an improved mattress lift apparatus that is light weight, durable, has no moving parts and is easy to use, transport and store.

A mattress lift apparatus is provided for separating a mattress and an underlying support structure. The mattress lift apparatus includes a body having a lift portion that extends longitudinally from a distal end to proximal end. The distal end has a first predefined height that is dimensioned to be inserted between the mattress and the underlying support structure. The proximal end has a second predefined height that is dimensioned to a desired elevation of the mattress. The body includes a body interior region defined within the lift portion. A handle is provided having a first handle end and a second handle end located opposite the first handle end. The first handle end and the second handle end are fixedly coupled to the body. An aperture is formed within the body so that the interior region of the body defines a perimeter around the aperture. The perimeter of the aperture and the handle define a continuous loop that provides structural strength to the mattress lift apparatus.

According to one embodiment, a mattress lift apparatus is provided for separating a mattress and an underlying support structure, which includes a base member, an incline member, a transition member and a handle. The base member includes a first base end and a second base end, the first base end being located opposite to the second base end. The incline member includes a first incline end and a second incline end, the first incline end being located opposite to the second incline end, the first incline end being mechanically coupled to and forming an acute angle with the first base end. The transition member includes a first transition end and a second transition end, the first transition end being located opposite to the second transition end, the first transition end being mechanically coupled to the second incline end.

The handle includes a first handle end and a second handle end, the first handle end being located opposite the second handle end, the first handle end being fixedly coupled to the second transition end and the second handle end being fixedly coupled to the second base end. The base member, the incline member, the transition member and the handle define a continuous loop that provides structural strength to the mattress lift apparatus. An aperture is formed within the continuous loop and at least one support rib is provided within the aperture to mechanically couple the base member and at least one of the inclined member and the transition member.

According to another embodiment, a method is provided for separating a mattress and an underlying support structure. The method includes aligning a mattress lift apparatus between the mattress and the underlying support structure. The mattress lift apparatus includes a body having a lift portion that extends longitudinally from a distal end to proximal end. The distal end has a first predefined height that is dimensioned to be inserted between the mattress and the underlying support structure. The proximal end has a second predefined height that is dimensioned to a desired elevation of the mattress. The body includes a body interior region defined within the lift portion. A handle is provided having a first handle end and a second handle end located opposite the first handle end. The first handle end and the second handle end are fixedly coupled to the body. An aperture is formed within the body so that the interior region of the body defines a perimeter around the aperture. The perimeter of the aperture and the handle define a continuous loop that provides structural strength to the mattress lift apparatus. A force is applied to the handle to insert the body of the mattress lift apparatus between the mattress and underlying support structure.

The invention provides numerous advantages over and avoids many drawbacks of prior devices. These and other features and advantages of the invention will be apparent through the detailed description of the embodiments and the drawings attached hereto. It is also to be understood that both the foregoing general description and the following detailed description are exemplary and not restrictive of the scope of the invention. Numerous other features and advantages of the invention should become apparent upon a reading of the following detailed description when taken in conjunction with the accompanying drawings, a brief description of which is included below.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
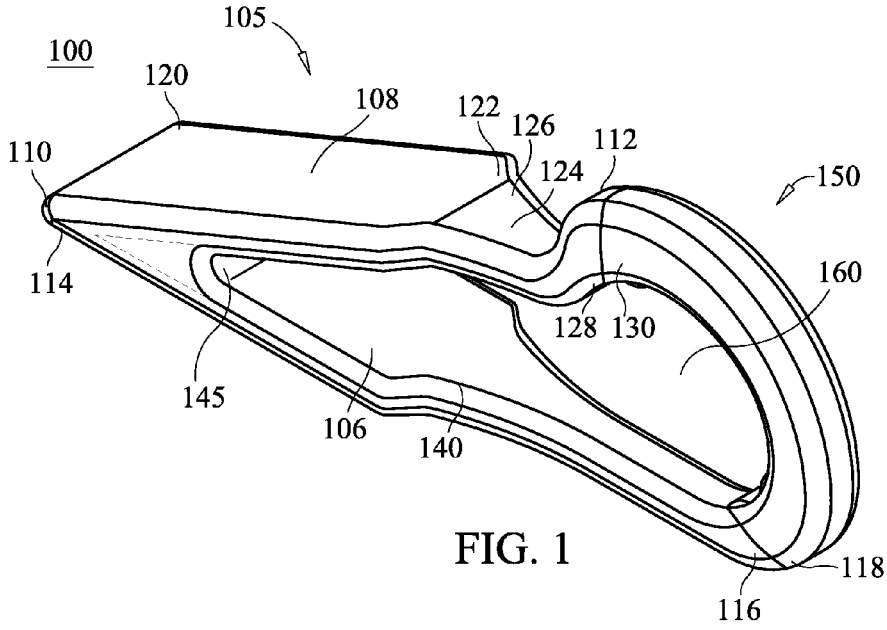
FIG. 1 illustrates a perspective view of the mattress lift apparatus according to one embodiment of the invention.

Before describing in detail exemplary embodiments that are in accordance with the invention, it is noted that like reference designators refer to like elements. FIG. 1 illustrates a mattress lift apparatus 100 according to one embodiment of the invention. The mattress lift apparatus 100 may be fabricated as a single piece. Alternatively, the mattress lift apparatus 100 may be fabricated from two pieces that are mechanically coupled. Alternatively, the mattress lift apparatus 100 may be fabricated from a plurality of pieces that are mechanically coupled. The pieces or members may be mechanically coupled using adhesive, welding, or other fastening technique.

For ease of discussion, the mattress lift apparatus 100 is described to include a body member 105 and a handle member 150. The body member 105 may be formed as a wedge shaped object. The body member 105 is further defined to include a base member 106, an incline member 108, a nose member 110 and a transition member 112. One of ordinary skill in the art will readily appreciate that the base member 106, the incline member 108, the nose member 110, the transition member 112 and the handle member 150 may be formed together in a single mold. Alternatively, one or more of these components may be formed separately. One-piece construction provides several benefits over multi-piece construction, including increased strength, reduced assembly cost, and fewer assembly parts, among providing other benefits.

The base member 106 may be formed from a substantially flat structure that is capable of supporting the body member 105 in an upright position as illustrated in FIG. 1. According to one embodiment, the base member 106 may include a wide portion 114 located proximate to the nose member 110. For example, the wide portion 114 may have a width of at least 1 inch. Other width dimensions that support an upright position are contemplated. The width of the base member 106 may taper and along the length direction to form a narrow portion 116 located adjacent to the bottom portion 118 of the handle member 150. For example, the base member 106 may have a larger width proximate to the nose member 110 and a narrow width proximate to the handle member 150. One of ordinary skill in the art will readily appreciate that the base member 106 may be formed from any of a plurality of shapes that are capable of supporting the body member 105 in the upright position.

Figure 7:
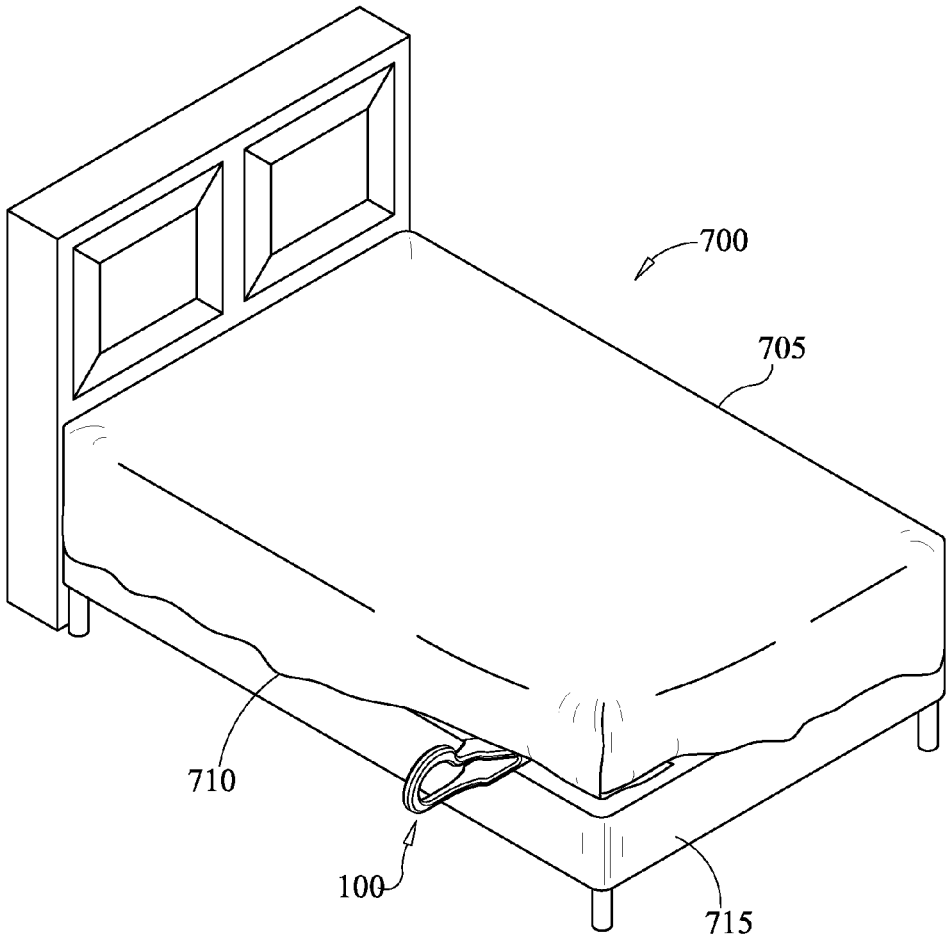
FIG. 7 illustrates a perspective side view of a mattress raised from a box spring with the aid of the mattress lift apparatus.

The incline member 108 may be formed from a substantially flat structure that is capable of supporting a mattress or other structure in an elevated position, as illustrated in FIG. 7. According to one embodiment, the incline member 108 may include a wide portion 120 located proximate to the nose member 110. For example, the wide portion 120 may have a width of at least 1 inch. Other width dimensions that support a mattress are contemplated. The width of the incline member 106 may taper along the length direction to form a narrow portion 122 located adjacent to the transition member 112. For example, the incline member 108 may have a larger width proximate to the nose member 110 and a narrow width proximate to the transition member 112. One of ordinary skill in the art will readily appreciate that the incline member 108 may be formed from any of a plurality of shapes that are capable of supporting the mattress in an elevated position.

The transition member 112 may be formed in a curved shape that is capable of supporting the mattress while abutting a side of the mattress to stop further penetration of the mattress lift apparatus 100. According to one embodiment, the transition member 112 may include a support surface 124 that supports the mattress when the mattress lift apparatus 100 is substantially fully inserted between the mattress and the underlying support structure. The support surface 124 may be configured to be substantially parallel to the base member 106. Alternatively, the support surface 124 may be configured to be non-parallel to the base member 106. For example, the support surface 124 may be angled to extend toward the base member 106, thereby forming a concave upper surface. According to one embodiment, the transition member 112 may include a wide portion 126 located proximate to the incline member 108. The width of the transition member 112 may taper along the length direction to form a narrow portion 128 located adjacent to the upper portion 130 of the handle member 150. One of ordinary skill in the art will readily appreciate that the transition member 112 may be formed to include any of a plurality of shapes that are capable of supporting the mattress in an elevated position while abutting a side surface of the mattress.

According to one embodiment, the handle member 150 may be formed to include a curvilinear shape. One of ordinary skill in the art will appreciate that the handle member 150 may be formed in other shapes. The handle member 150 extends from the transition member 112 to the base member 106, providing an extended gripping area along a perimeter of the handle member 150. The handle member 150 is coupled to the transition member 112 and provides structural support to the transition member 112 to limit penetration of the mattress lift apparatus 100 between the mattress and the box spring. The handle member 150 is coupled to the base member 106, forming a closed or continuous loop 140 defined by the base member 106, the incline member 108, the transition member 112 and the handle member 150. The continuous loop 140 configuration strengthens the structural integrity of the mattress lift apparatus 100.

Figure 2:
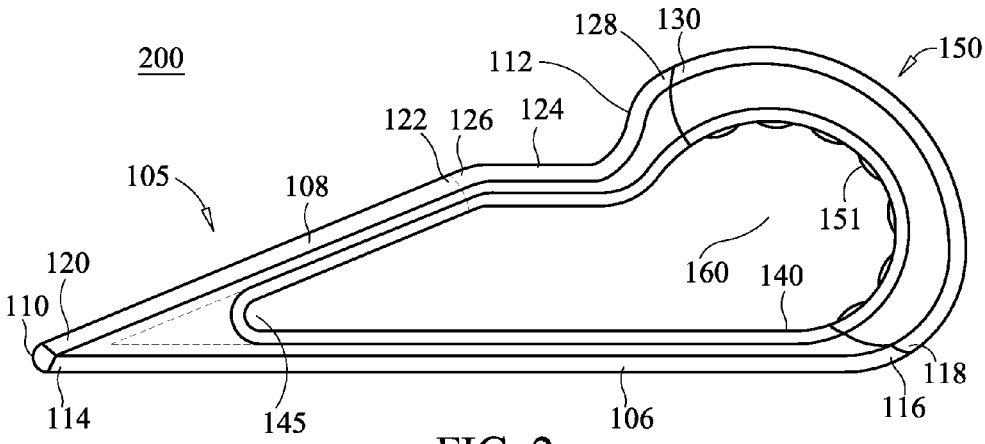
FIG. 2 illustrates a side view of the mattress lift apparatus according to one embodiment of the invention.

According to one embodiment, the handle member 150 may include finger grips or protrusions 151 that improve comfort and control. The handle member 150 may be configured in a curved path to extend upward from the base member 106 to the transition member 112, as illustrated in FIG. 2. The curvilinear shape of the handle member 150 may increase a length of the gripping surface. As a result, users may grip the handle member 150 with two hands to provide additional force to insert the mattress lift apparatus 100 between the mattress and box spring. The curvilinear shape of the handle member 150 also provides a range of comfortable gripping position that suit different user heights. For example, taller users may grip the handle member 150 higher on the curved handle member 150 or closer to the transition member 112. By contrast, shorter users may grip the handle member 150 lower on the curved handle member 150 or closer to the base member 106. The handle member 150 is configured to be gripped from either side to suit both right hand and left hand users.

The mattress lift apparatus 100 may include an aperture 160 that is located in an interior region of the device. According to one embodiment illustrated in FIG. 1, the aperture 160 may be defined by inner surfaces of the base member 106, the incline member 108, the transition member 112 and the handle member 150. One of ordinary skill in the art will readily appreciate that the aperture 160 may be defined to include an area smaller than illustrated in FIG. 1.

Figure 3:
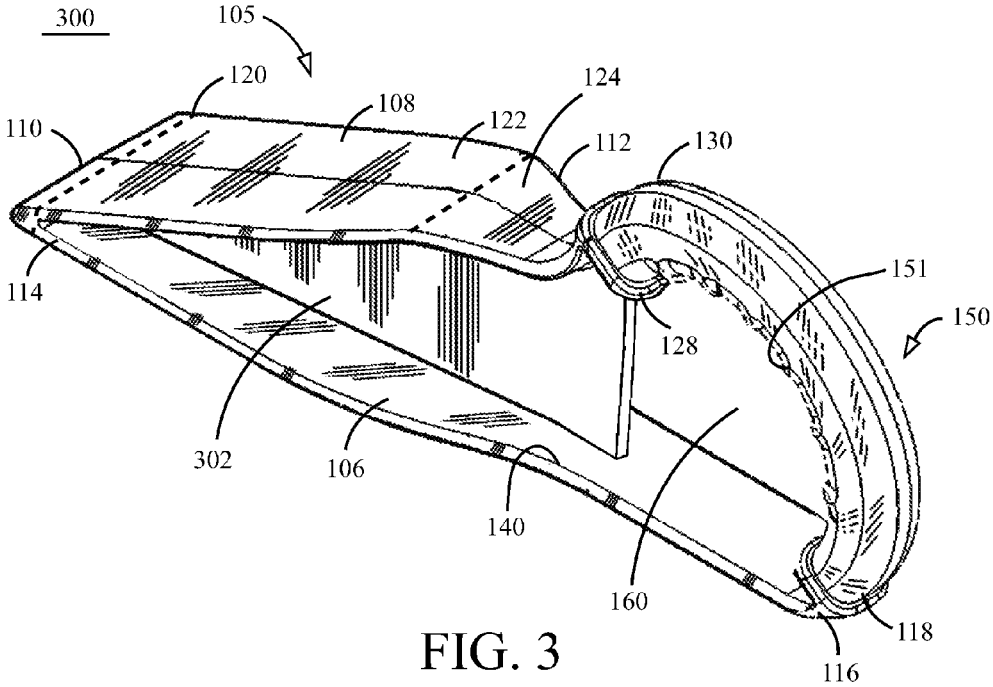
FIG. 3 illustrates a perspective view of the mattress lift apparatus according to a second embodiment of the invention.
Figure 4:
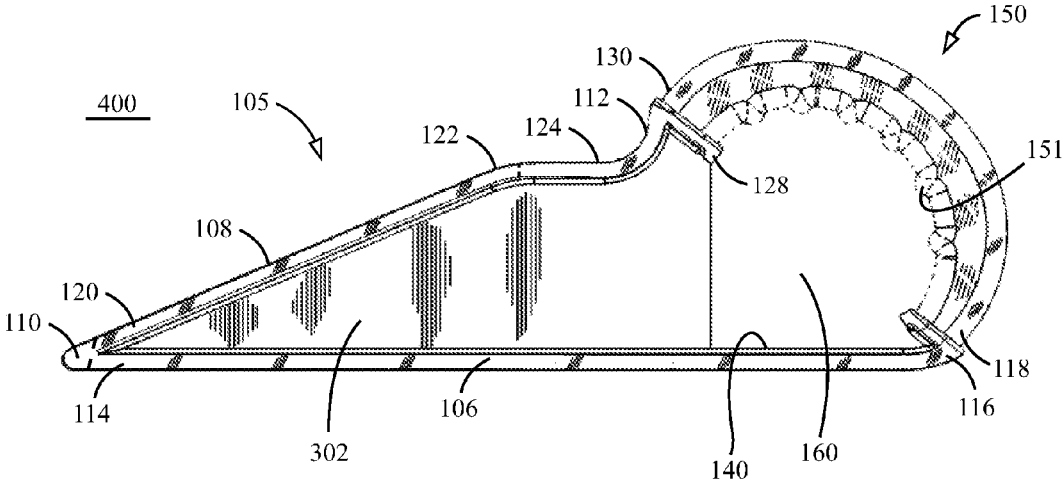
FIG. 4 illustrates a side view of the mattress lift apparatus according to a second embodiment of the invention.

FIGS. 3 and 4 illustrate a second embodiment of the invention showing the aperture 160 defined in an area proximate to the handle member 150. In this embodiment, a rib 302 is positioned in the interior region of the mattress lift apparatus 300. The rib 302 may be positioned to couple the base member 106, the incline member 108 and the transition member 112. One of ordinary skill in the art will readily appreciate that the rib 302 may be provided in other configurations to couple inner surfaces defined by the continuous loop 140. The rib 302 provides increased structural support to the mattress lift apparatus 300. Accordingly, the thickness of the material used to form the members, including the base member 106, the incline member 108 and the transition member 112 may be reduced. Reducing the thickness of the base member 106, the incline member 108 and the transition member 112, while maintaining the structural strength of the mattress lift apparatus provides several advantages, including providing material cost saving, among other benefits.

Figure 5:
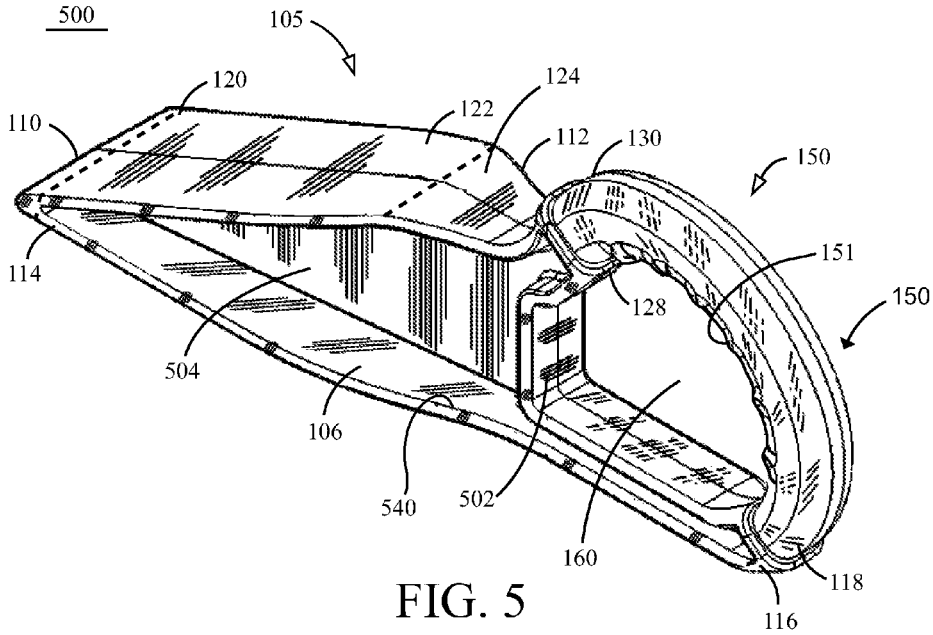
FIG. 5 illustrates a perspective view of the mattress lift apparatus according to a third embodiment of the invention.
Figure 6:
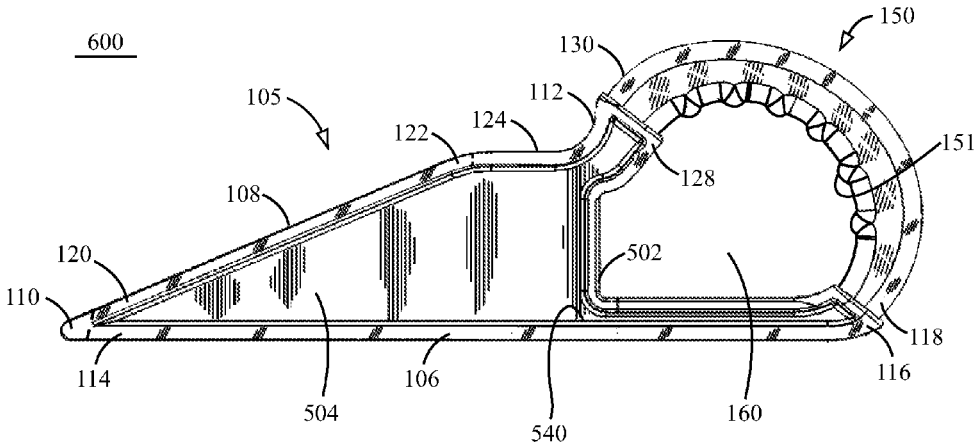
FIG. 6 illustrates a side view of the mattress lift apparatus according to a third embodiment of the invention.

FIGS. 5 and 6 illustrate a third embodiment of the invention showing the aperture 160 defined in an area proximate to the handle member 150. A reinforcing member 502 is provided to increase the structural strength of the mattress lift apparatus 400. In this embodiment, the reinforcing member 502 couples the transition member 112 to the base member 106, forming a closed or continuous loop 540 defined by the base member 106, the incline member 108, the transition member 112 and the reinforcing member 502. The continuous loop 540 configuration strengthens the structural integrity of the mattress lift apparatus 500.

The reinforcing member 502 may be positioned to couple other structural members, including coupling the incline member 108 to the base member 106, coupling the handle member 150 to the base member 106, among providing other coupling configurations. In this case, the continuous loop 540 may be defined by these corresponding members. One of ordinary skill in the art will readily appreciate that the reinforcing member 502 may be formed in any shape. For example, the reinforcing member 502 may be formed as a straight element to couple the transition member 112 and the base member 106 (not illustrated).

According to one embodiment, a rib 504 may be used in conjunction with the reinforcing member 502 to increase structural strength of the mattress lift apparatus 500. As illustrated in FIGS. 5 and 6, the reinforcing member 502 may be positioned within the interior region of the mattress lift apparatus to minimize the size of the aperture 160. The rib 504 may be positioned between the inner surfaces defined by the continuous loop 540. As illustrated, the rib 504 may be positioned to couple the base member 106, the incline member 108, the transition member 112 and the reinforcing member 502. One of ordinary skill in the art will readily appreciate that the rib 504 may be provided in other configurations to couple inner surfaces defined by the continuous loop 540. Other configurations for the rib 504 are contemplated. The reinforcing member 502 and the rib 504 provide increased structural support to the mattress lift apparatus 500. Accordingly, the thickness of the material used to form the members, including the base member 106, the incline member 108 and the transition member 112 may be reduced. Reducing the thickness of the base member 106, the incline member 108 and the transition member 112, while maintaining the structural strength of the mattress lift apparatus provides several advantages, including providing material cost saving, among other benefits.

The edges of the mattress lift apparatus may be radiused and substantially smooth to avoid snagging or tearing the mattress, the underlying support structure, and bed linens, among other items. The base member 106 and the incline member 108 may be formed having a larger width than the handle member 150 to resist tilting, twisting or falling over when the mattress lift apparatus is inserted between the mattress and the underlying support structure. According to one embodiment, the mattress lift apparatus may be at least one inch wide proximate to the nose member 110. The incline member 108 and the base member 106 may form an internal radiused surface 145. When not in use, the aperture 160 may be used to hang the mattress lift apparatus from a suitable structure, such as a hook or other structure (not shown). For example, mattress lift apparatus may be affixed to a user's belt, on a service cart, or in a storage area, among other suitable locations. Other portions of the mattress lift apparatus may be engaged to secure the device while stored or transported.

The mattress lift apparatus may be configured to receive a suitable logo, company name, or emblem. For example, the logo, company name, or emblem may be molded, stamped, printed, or painted on at least one of the rib 302, rib 502, handle member 150, the base member 106, the incline member 108, or other smoothed surface, among other locations.

According to one embodiment, the mattress lift apparatus may be constructed of any suitable material, including plastic, metal, fiberglass, wood, or other suitable material. According to one embodiment, the mattress lift apparatus includes no moving parts, thereby simplifying assembly and construction. The mattress lift apparatus may be constructed to be light weight and may be molded or painted in any desirable color, or combination of colors.

According to one embodiment, the mattress lift apparatus may be molded, blow molded, fabricated, or otherwise formed by any known process or procedure. When made of plastic, the material may be molded of a plastic material, such as polyethylene, or other suitable plastic material. Manufacturing the mattress lift apparatus using a blow molding process forms a hollow inner core that extends substantially throughout the members defining the closed or continuous loop structure. The hollow inner core reduces the weight of the mattress lift apparatus, while saving material cost.

FIG. 7 illustrates the mattress lift apparatus in an intended environment 700. The mattress lift apparatus may be used to lift a portion of mattress 705 to enable tucking in of bed linens 710 between the mattress 705 and the underlying support structure 715, such as a box spring or other support structure. The bed linens 710 may include upper and lower sheets and/or blankets. The bed linens 710 may be draped over the mattress 705 and may be permitted to extend below an interface defined between the mattress 705 and box spring 715.

The mattress lift apparatus may be positioned adjacent to the interface defined between the mattress 705 and box spring 715. For example, the mattress lift apparatus may be positioned at different location around the mattress 705, such as along an edge, at the corners or other locations of the mattress. The mattress lift apparatus may include any of the embodiments disclosed within this specification.

When aligned, the nose member 110 of the mattress lift apparatus may be positioned for insertion between a bottom surface of the mattress 705 and a top surface of the box spring 715. A force may be applied to the mattress lift apparatus to cause insertion of the device between a bottom surface of the mattress 705 and a top surface of the box spring 715. For example, a lateral force may be applied to the handle member 150 to cause insertion of the device between a bottom surface of the mattress 705 and a top surface of the box spring 715. During insertion, the incline member 108 engages the mattress 705 and the base member 106 engages the box spring 715. With continued insertion between the mattress 705 and the box spring 715, the mattress lift apparatus elevates a selected portion of the mattress to enable tucking in of bed linens 710 there-between. The insertion of the mattress lift apparatus may also cause a portion of one or more bed linens 710 that hang below the interface between the mattress 705 and the box spring 715 to be tucked between the bed mattress 705 and box spring 715 in the area where the device is inserted.

The mattress lift apparatus is configured to abut the mattress 705 when fully inserted between the mattress 705 and the box spring 715. For example, the transition member 112 and/or handle member 150 may be configured to abut the mattress 705. At abutment, lateral movement of the mattress lift apparatus between the mattress 705 and the box spring 715 is stopped. Upon completing the intended task of tucking in the bed linens, the mattress lift apparatus may be withdrawn and moved to a new location between the mattress 705 and the box spring 715. The bed linens 710 may remain tucked in between the mattress 705 and the box spring 715 after the mattress lift apparatus is removed. It is contemplated that other tasks may be performed while the mattress lift apparatus is positioned between the mattress 705 and the box spring 715. As desired, the mattress lift apparatus may be re-inserted between the mattress 705 and the box spring 715 at another location. This process may be repeated until the bed linens 710 are satisfactorily tucked in all along the sides and end of the mattress 705. According to another embodiment, a plurality of mattress lift apparatuses may be provided to concurrently lift several portions of the mattress 705.

The mattress lift apparatus serves to support the mattress 705 in a raised position, as illustrated in FIG. 7. While the mattress remains in the elevated position, the mattress lift apparatus may be briefly left unattended to enable the user to adjust or align the bed linens 710 or perform another action. The mattress lift apparatus is configured to remain in the upright position while unattended. For example, the mattress lift apparatus is designed to include a sufficiently wide dimension at the nose member 110, the base member 106 and/or the incline member 108 to maintain the device in a upright position while supporting the mattress 705.

It is understood that the above-described arrangements are merely illustrative of the many possible specific embodiments, which represent applications of the present invention. In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A mattress lift apparatus for separating a mattress and an underlying support structure, the mattress lift apparatus comprising:

a body comprising:

a lift portion extending longitudinally from a distal end to proximal end, the distal end having a first predefined height that is dimensioned to be inserted between the mattress and the underlying support structure and the proximal end having a second predefined height that is dimensioned to a desired elevation of the mattress;

a body interior region defined within the lift portion;

a handle comprising:

a first handle end; and a second handle end located opposite the first handle end, the first handle end and the second handle end being fixedly coupled to the body;

an aperture defined by the body, the aperture having a perimeter located within the body interior region; and a continuous loop defined by the perimeter of the aperture and the handle.

2. The mattress lift apparatus according to claim 1, wherein the body further comprises:

a base member having a first base end and a second base end, the first base end being located opposite to the second base end;

an incline member having a first incline end and a second incline end, the first incline end being located opposite to the second incline end, the first incline end being mechanically coupled to and forming an acute angle with the first base end;

a transition member having a first transition end and a second transition end, the first transition end being located opposite to the second transition end, the first transition end being mechanically coupled to the second incline end.

3. The mattress lift apparatus according to claim 2, wherein the first handle end is fixedly coupled to the second transition end and the second handle end is fixedly coupled to the second base end and wherein the continuous loop is defined by the base member, the incline member, the transition member and the handle.

4. The mattress lift apparatus according to claim 2, further comprising a rounded nose member formed adjacent to the first incline end and the first base end, the rounded nose member being dimensioned to insert between the mattress and the underlying support structure.

5. The mattress lift apparatus according to claim 2, wherein the rounded nose member includes a width dimension of at least one inch and wherein a portion of the inclined member and the base member located adjacent to the rounded nose member include a width dimension of at least one inch to maintain an upright position while inserted between the mattress and the underlying support structure.

6. The mattress lift apparatus according to claim 2, wherein a portion of the handle adjacent to the first handle end is shaped to abut the mattress, thereby limiting penetration of the mattress lift apparatus between the mattress and the underlying support structure.

7. The mattress lift apparatus according to claim 1, wherein the transition member includes a width that tapers between a width of the second incline end and a width of the first handle end and wherein the transition member is oriented relative to the base member to include one of being substantially parallel to the base member and being non-parallel to the base member.

8. The mattress lift apparatus according to claim 1, further comprising at least one support rib positioned in the aperture to mechanically couple portions of the perimeter of the continuous loop.

9. The mattress lift apparatus according to claim 1, further comprising a reinforcing member positioned within the aperture to couple selected portions of the body.

10. The mattress lift apparatus according to claim 2, wherein the incline member has a width dimension that narrows between the first incline end and the second incline end.

11. A mattress lift apparatus for separating a mattress and an underlying support structure, the mattress lift apparatus comprising:

a base member having a first base end and a second base end, the first base end being located opposite to the second base end;

an incline member having a first incline end and a second incline end, the first incline end being located opposite to the second incline end, the first incline end being mechanically coupled to and forming an acute angle with the first base end;

a transition member having a first transition end and a second transition end, the first transition end being located opposite to the second transition end, the first transition end being mechanically coupled to the second incline end;

a handle having a first handle end and a second handle end, the first handle end being located opposite the second handle end, the first handle end being fixedly coupled to the second transition end and the second handle end being fixedly coupled to the second base end;

a continuous loop defined by the base member, the incline member, the transition member and the handle;

an aperture defined within the continuous loop; and at least one support rib provided within the aperture to mechanically couple the base member and at least one of the inclined member and the transition member.

12. The mattress lift apparatus according to claim 11, further comprising a reinforcing member having a first support end and a second support end, the first support end being opposite the second support end, the first support end being mechanically coupled to the second transition end and the second support end being mechanically coupled to the second base end.

13. The mattress lift apparatus according to claim 11, further comprising a rounded nose member formed adjacent to the first incline end and the first base end, the rounded nose member being dimensioned to insert between the mattress and the underlying support structure.

14. The mattress lift apparatus according to claim 13, wherein the rounded nose member includes a width dimension of at least one inch and wherein a portion of the inclined member and the base member located adjacent to the rounded nose member include a width dimension of at least one inch to maintain an upright position while inserted between the mattress and the underlying support structure.

15. The mattress lift apparatus according to claim 13, wherein the base member, the incline member, the transition member, the handle and the rounded nose member include rounded edges and smooth edges to prevent damaging the mattress and the underlying support structure.

16. The mattress lift apparatus according to claim 11, wherein a portion of the handle adjacent to the first handle end is shaped to abut the mattress, thereby limiting penetration of the mattress lift apparatus between the mattress and the underlying support structure.

17. The mattress lift apparatus according to claim 11, wherein the transition member includes a width that tapers between a width of the second incline end and a width of the first handle end and wherein the transition member is oriented relative to the base member to include one of being substantially parallel to the base member and being non-parallel to the base member.

18. The mattress lift apparatus according to claim 11, wherein the incline member has a width dimension that narrows between the first incline end and the second incline end.

19. A method for separating a mattress and an underlying support structure, the method comprising:

aligning a mattress lift apparatus between the mattress and the underlying support structure, the mattress lift apparatus comprising:

a body having a lift portion extending longitudinally from a distal end to proximal end, the distal end having a first predefined height that is dimensioned to be inserted between the mattress and the underlying support structure and the proximal end having a second predefined height that is dimensioned to a desired elevation of the mattress and a body interior region defined within the lift portion;

a handle including a first handle end, and a second handle end located opposite the first handle end, the first handle end and the second handle end being fixedly coupled to the body member;

an aperture defined by the body, the aperture having a perimeter located within the body interior region; and a continuous loop defined by the perimeter of the aperture and the handle; and applying a force to the handle to insert the body of the mattress lift apparatus between the mattress and underlying support structure.

20. The method according to claim 19, further comprising elevating a selected portion of the mattress to enable inserting bed linens between the mattress and the underlying support structure.

* * * * *